US008903298B2

(12) United States Patent
Klenkler et al.

(10) Patent No.: US 8,903,298 B2
(45) Date of Patent: Dec. 2, 2014

(54) INTERMITTENT APPLICATION OF LUBRICANT TO ELECTROSTATIC SURFACE

(71) Applicant: Xerox Corporation, Norwalk, CT (US)

(72) Inventors: Richard A. Klenkler, Oakville (CA); Sarah J. Vella, Milton (CA); Yu Liu, Ontario (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/835,964

(22) Filed: Mar. 15, 2013

(65) Prior Publication Data

US 2014/0270880 A1 Sep. 18, 2014

(51) Int. Cl.
*G03G 21/00* (2006.01)

(52) U.S. Cl.
CPC ..... *G03G 21/0094* (2013.01)
USPC ..... 399/346; 399/345; 399/353; 184/17; 184/99

(58) Field of Classification Search
USPC ..... 399/34, 71, 343, 345, 346, 353; 184/14, 184/17, 99
See application file for complete search history.

(56) References Cited

U.S. PATENT DOCUMENTS

| | | | | |
|---|---|---|---|---|
| 5,510,886 | A * | 4/1996 | Sugimoto et al. | 399/308 |
| 6,858,362 | B2 | 2/2005 | Tamoto et al. | |
| 7,542,712 | B2 | 6/2009 | Tanaka et al. | |
| 7,715,750 | B2 * | 5/2010 | Kagawa | 399/100 |
| 7,756,439 | B2 | 7/2010 | Kosuge et al. | |
| 8,041,259 | B2 | 10/2011 | Narita et al. | |
| 2004/0136757 | A1 * | 7/2004 | Sawai | 399/297 |
| 2004/0265023 | A1 * | 12/2004 | Yoshida et al. | 399/346 |
| 2007/0166087 | A1 * | 7/2007 | Yamaguchi et al. | 399/346 |
| 2009/0052959 | A1 * | 2/2009 | Tomoe | 399/346 |
| 2009/0279927 | A1 | 11/2009 | Fujita | |
| 2009/0324310 | A1 * | 12/2009 | Matsumoto et al. | 399/346 |
| 2010/0232831 | A1 | 9/2010 | Fujiwara et al. | |
| 2012/0201585 | A1 | 8/2012 | Hu et al. | |
| 2012/0237228 | A1 | 9/2012 | Kami | |

FOREIGN PATENT DOCUMENTS

| | | |
|---|---|---|
| EP | 0675809 | 10/1995 |
| EP | 1274515 | 1/2003 |

OTHER PUBLICATIONS

U.S. Appl. No. 13/192,215, filed Jul. 27, 2011; Hu et al; Apparatus and Methods for Delivery of a Functional Material to an Image Forming Member.
U.S. Appl. No. 13/192,252, filed Jul. 27, 2011; Vella et al; Composition for Use in an Apparatus for Delivery of a Functional Material to an Image Forming Member.
U.S. Appl. No. 13/286,905, filed Nov. 1, 2011; McGuire et al; Apparatus and Methods for Delivery of a Functional Material to an Image Forming Member.
U.S. Appl. No. 13/279,981, filed Oct. 24, 2011; Vella et al; Delivery Apparatus and Method.

(Continued)

*Primary Examiner* — Francis Gray
(74) *Attorney, Agent, or Firm* — Gibb & Riley, LLC

(57) ABSTRACT

Methods and devices provide an electrostatically chargeable surface within a printing apparatus and cause a movable lubricant applicator to contact the electrostatically chargeable surface. The movable lubricant applicator is movable to be in contact with the electrostatically chargeable surface, or out of contact with the electrostatically chargeable surface. Such methods control the movable lubricant applicator to be in intermittent contact with the electrostatically chargeable surface during printing operations of the printing apparatus.

20 Claims, 4 Drawing Sheets

(56) References Cited

OTHER PUBLICATIONS

U.S. Appl. No. 13/326,414, filed Dec. 15, 2011; McGuire et al—Delivery Apparatus.

U.S. Appl. No. 13/566,541, filed Aug. 3, 2012; Liu et al; A Bias Charge Roller and Apparatus Incorporating the Bias Charge Roller.

U.S. Appl. No. 13/426,836, filed Mar. 22, 2012; Vella et al; Delivery Apparatus.

* cited by examiner

INTERMITTENT APPLICATION OF LUBRICANT TO ELECTROSTATIC SURFACE

BACKGROUND

Systems and methods herein generally relate to printing devices and more particularly to printing devices that use an applicator to deliver lubricant to an electrostatic surface.

Lubricant delivery roller systems in modern printers have shown tremendous potential for improving image quality with over-coated photoreceptors in charged systems (by reducing cleaning blade related torque and deletion of image quality defects). Further, such lubricant delivery roller systems reduce photoreceptor wear rate and the propensity for filming.

Many systems control the delivery of trace amounts of lubricant (such as paraffin oil, or other liquid materials) to the surface of a photoreceptor. In these, delivery of the lubricant serves as a means to mitigate deletion and reduce cleaning blade friction in systems with over-coated photoreceptors and BCR (biased charge roll) charging systems. Applying a nanometer-thin layer of lubricant as a refreshable, sacrificial barrier to protect the photoreceptor surface controls delivery of the lubricant. For example, an oil-infused elastomeric roller can deliver the lubricant oil either directly to the photoreceptor surface or to the BCR that then transfers the oil to the photoreceptor surface. In either case, the delivery roller is in constant contact and is continuously delivering oil to the surface.

SUMMARY

Exemplary methods herein provide an electrostatically chargeable surface within a printing apparatus (e.g., photoreceptor belt, photoreceptor drum, biased charge roller, etc.) and cause a movable lubricant applicator to contact the electrostatically chargeable surface. The movable lubricant applicator is movable to be in contact with the electrostatically chargeable surface, or out of contact with the electrostatically chargeable surface. Such methods control the movable lubricant applicator to be in intermittent contact with the electrostatically chargeable surface during printing operations of the printing apparatus. The movable lubricant applicator (e.g., a brush or roller) only applies a lubricant when in contact with the electrostatically chargeable surface, and the lubricant can comprise, for example, paraffin lubricant, etc.

In specific examples, the methods can control the movable lubricant applicator to be in contact with the electrostatically chargeable surface less than one-third of any time period during the printing operations of the printing apparatus.

A printing apparatus embodiment herein comprises an electrostatically chargeable surface, a movable lubricant applicator contacting the electrostatically chargeable surface, and a controller operatively connected to the movable lubricant applicator. As indicated above, the movable lubricant applicator is movable to be in contact with the electrostatically chargeable surface, or out of contact with the electrostatically chargeable surface (under control of the controller). Further, the controller controls the movable lubricant applicator to be in intermittent contact with the electrostatically chargeable surface during printing operations of the printing apparatus.

These and other features are described in, or are apparent from, the following detailed description.

BRIEF DESCRIPTION OF THE DRAWINGS

Various exemplary systems and methods of the systems and methods are described in detail below, with reference to the attached drawing figures, in which.

DETAILED DESCRIPTION

Many systems control the delivery of trace amounts of lubricant (such as paraffin oil, silicone oil, fluorine-based oil, or other lubricating materials) to the surface of a photoreceptor. Ideally, the delivery roller would last the life of the photoreceptor cartridge. This disclosure addresses the optimization of the delivery of lubricant oil by intermittent contact with the photoreceptor (or BCR) surface, which results in an increase in the lifetime of the delivery roller.

This disclosure includes methods/systems for optimized implementation of the delivery roller in a printing system. It was determined that the delivery roller does not need to be in constant contact with the photoreceptor (or BCR) and methods and systems herein apply lubricant most efficiently when the delivery roller is put in intermittent contact with the photoreceptor (or BCR). That is to say that the delivery roller is placed in contact with the photoreceptor for a number of cycles and then held out of contact for a number of cycles. It was found that delivery of lubricant was most effective when the duration of contact was half the duration of non-contact e.g., contact for 5 cycles and non-contact for 10 cycles. This process of intermittent application of lubricant allows for a 3 fold increase in delivery roller life, e.g. for a 30 mm photoreceptor drum intermittent application can extend delivery roll life from approximately 850 Kcycles to approximately 2500 Kcycles.

The approach to extending delivery roller life that is outlined in this ID was unexpected (and even possibly somewhat counter-intuitive). In fact, it was an accidental discovery that occurred when a delivery roller was removed from a test photoreceptor CRU and then the CRU was mistakenly reinstalled in the machine without a delivery roller. Contrary to what would be expected, the over-coated photoreceptor continued to print for several hundred prints before the return of high torque related cleaning blade chatter and deletion image quality defects. Further experimentation revealed that the delivery roller need only be intermittently placed in contact with the photoreceptor to be effective.

Based on the initial observation that it was not necessary for the delivery roller to be in continuous contact with the photoreceptor, experiments were preformed to optimize the rate of lubricant delivery by finding the ideal ratio of in-contact cycles to out-of-contact cycles. Tests were performed using an over-coated photoreceptor and toner combination that had previously shown high cleaning blade friction and deletion image quality defects.

Figure 1:
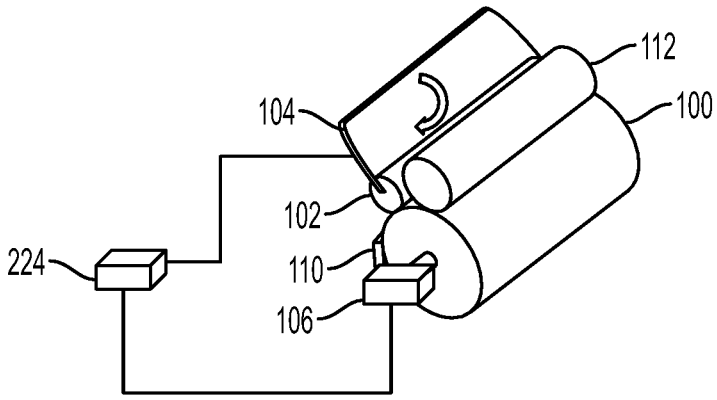
FIG. 1 is a perspective-view schematic diagram of a device according to systems and methods herein.

FIG. 1 is a schematic drawing generally illustrating a photoreceptor consumer replaceable unit (CRU) with delivery roller 102 in contact with the photoreceptor 100. An actuator 104 moves the delivery roller 102 (under control of a controller 224) toward and away from the photoreceptor 100 to allow for the delivery roller 102 to be placed in and out of contact with the photoreceptor 100 during printing operations. Alternatively, the delivery roller 102 can be moved in and out of contact with the biased charge roller is shown as item 112. The photoreceptor drive motor 106 is coupled with a torque transducer (which is connected to the controller 224) allowing for the friction between the photoreceptor 100 and a cleaning blade 110 to be measured.

Figure 2:
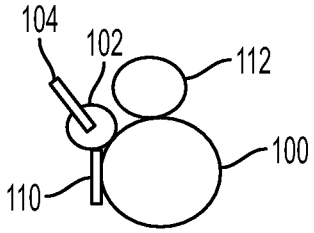
FIG. 2 is a side-view schematic diagram of a device according to systems and methods herein.
Figure 3:
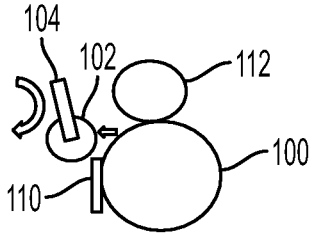
FIG. 3 is a side-view schematic diagram of a device according to systems and methods herein.

The geometry of the test fixture allows for the actuator 104 to be installed to intermittently place the lubricant delivery roller 102 in contact with the photoreceptor 100. For example, FIG. 2 illustrates the delivery roller 102 in contact with the photoreceptor 100, and FIG. 3 illustrates the delivery roller 102 out of contact with the photoreceptor 100 (not being in contact with the photoreceptor 100.).

Exemplary testing was performed to find the ideal ratio of in-contact cycles to out-of-contact cycles. Several separate test runs were performed to establish repeatability. In addition, the test was run at different BCR charge settings to determine the effectiveness and optimal ratio of delivery roller application as a function of photoreceptor charging level. Each test run proceeded according to the following pattern:

| Phase | BCR | Delivery Roller | Purpose |
|---|---|---|---|
| 1 | Off | Out of Contact | Determine Baseline Torque without charging |
| 2 | On | Out of Contact | Determine Baseline Torque with charging |
| 3 | Off | In Contact | Determine Baseline Torque without charging but with oil applied |
| 4 | On | Continuous Contact | Determine Baseline Torque with charging while oil applied |
| 5 | On | Intermittent Contact | Apply Oil while Charging, vary the duration of in-contact cycles to out-of-contact cycles to find optimum ratio of delivery |

Figure 4:
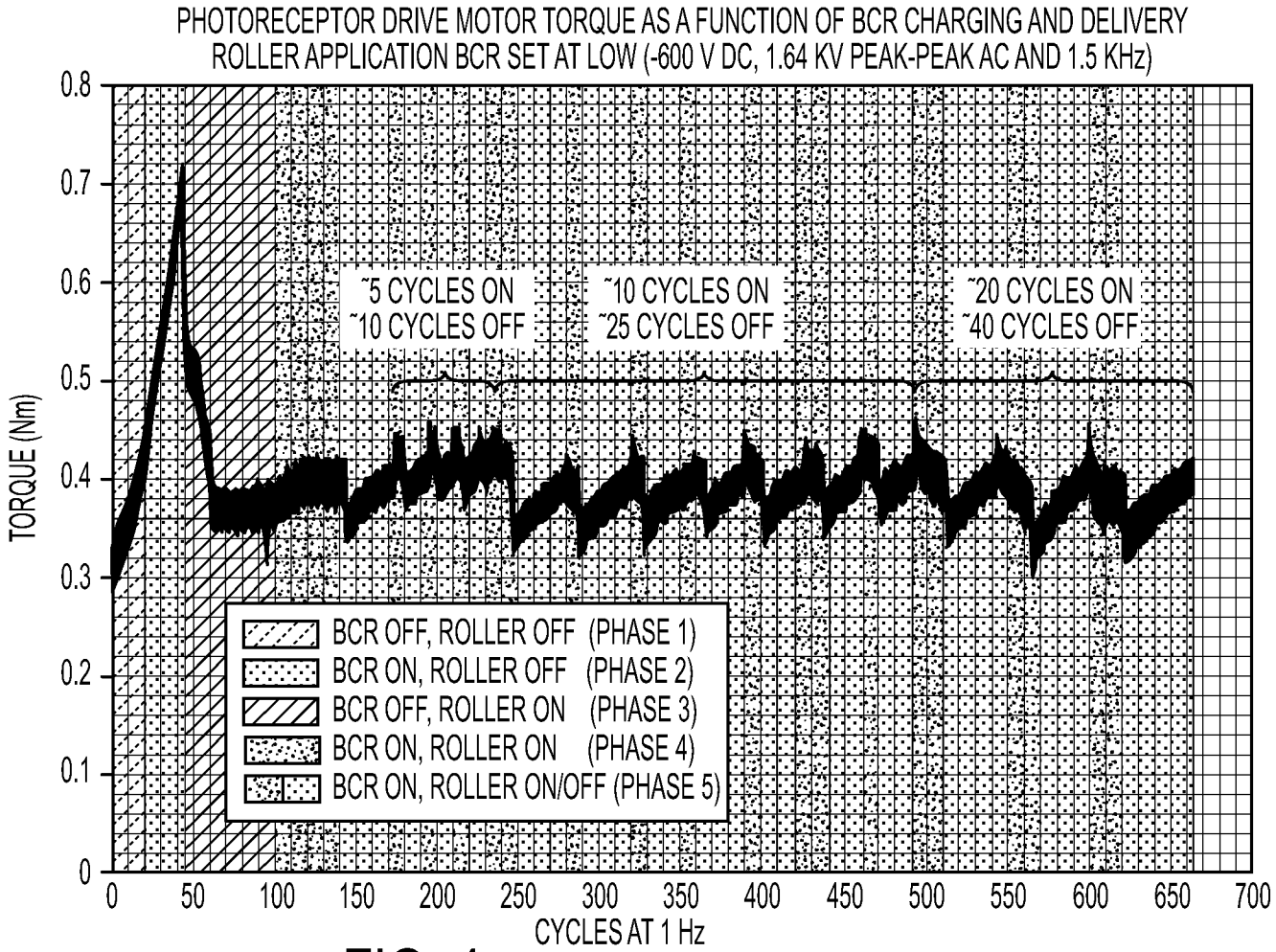
FIG. 4 is a chart illustrating performance results of systems and methods herein.
Figure 5:
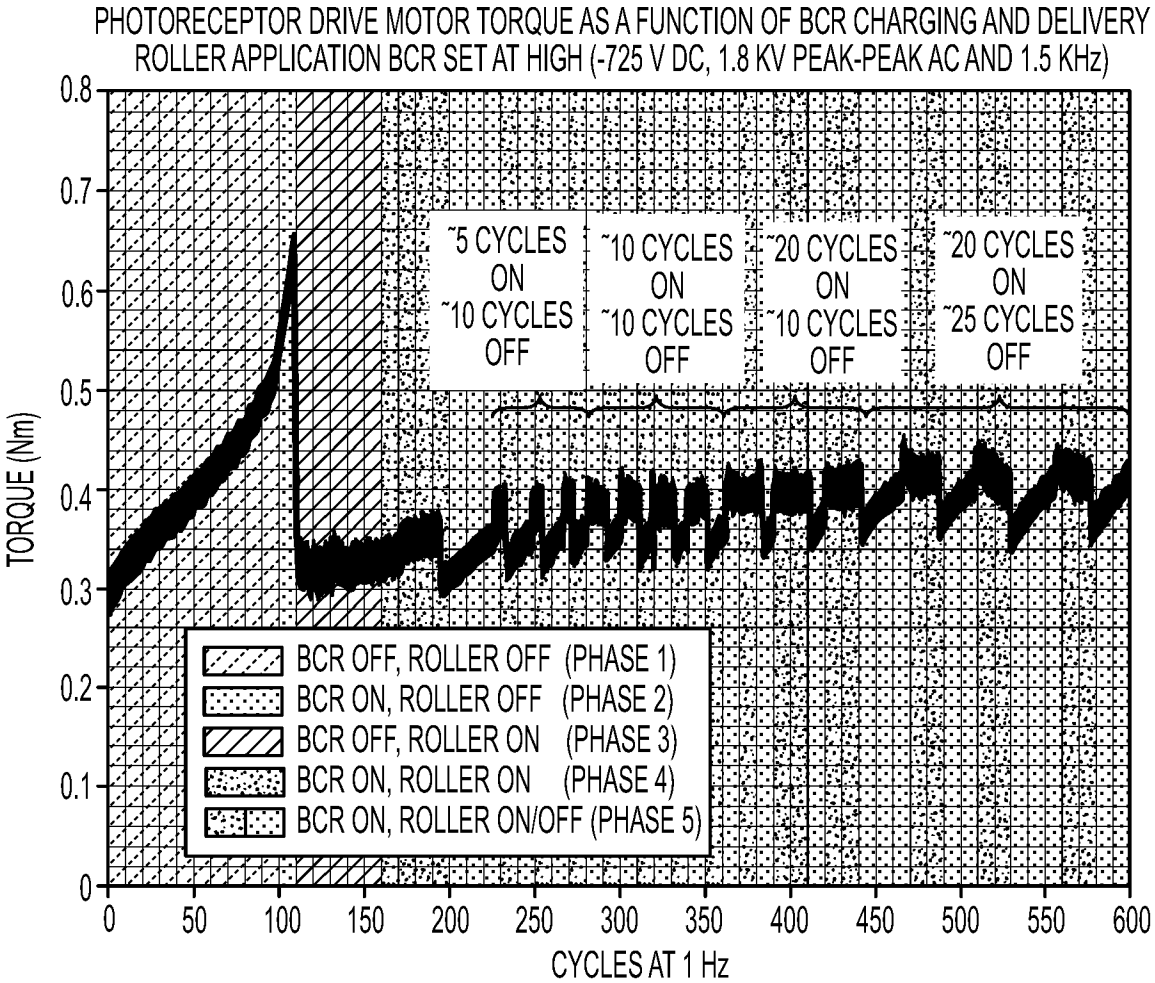
FIG. 5 is a chart illustrating performance results of systems and methods herein.

Each phase was run until a steady state was reached or, if torque increased monotonically, until the torque reached an unstable level. During the intermittent contact phase, the duration of in-contact to out-of-contact cycles was varied. The duration of the in-contact period was tested at predetermined lengths, such as 5 cycles, 10 cycles, 20 cycles, etc. The duration of the out-of-contact period was based on the rise in the torque profile, where the delivery roller was placed back in contact with the photoreceptor once the torque has risen back up to the baseline level. In this way, the minimum ratio of in-contact to out-of-contact cycles could be determined. That is to say, the maximum number of out-of-contact cycles (given a set number of in-contact cycles) that could be sustained while maintaining the same overall torque reduction as with continuous application. Results from each test run are shown in FIGS. 4 and 5. More specifically, FIG. 4 shows a torque plot in the case that the BCR was run at the low setting, and FIG. 5 shows a torque plot in the case that the BCR was run at the high setting.

As shown in FIG. 4, in phase 1, with BCR charging off and delivery roller out-of-contact, the torque is seen to rise steadily as the system runs without lubrication. In phase 2, with BCR charging on and delivery roller out-of-contact, the torque rises exponentially as the BCR plasma increases friction between the photoreceptor surface and the cleaning blade. In phase 3, with BCR charging off and delivery roller in-contact, torque drops immediately as the lubricant is delivered to the photoreceptor decreases friction. In phase 4, with BCR charging on and delivery roller in continuous contact, torque rises slightly but levels off as the friction increasing effect of the plasma is mitigated by the continuous application of the lubricant. In phase 5, with BCR charging on and delivery roller in intermittent contact, the torque initially when the delivery roll is pulled out of contact with the photoreceptor, as the drive motor no longer needs to drive the delivery roller. Once the delivery roller is out of contact, torque increases monotonically until it reaches the steady state level at the end of phase 4, at which point it was predetermined to reengage the delivery roller for another set of cycles.

After applying lubricant for a set number of cycles the delivery roller was again pulled out of contact with the photoreceptor and correspondingly the torque dropped. Again torque was allowed to build to the steady state level reached in phase 4 before the delivery roller was reengaged.

In this way, the delivery could be optimized based on the ratio of the number of cycles that the delivery roller needs to be in contact versus the number of cycles that it can be out of contact, without the torque rising above the continuous application steady state level of phase 4. With the BCR at the low setting, the ratio of cycles with roller application on to roller application off that is needed to maintain the same torque as continuous application (phase 4) is 1:2, as shown in Table 1. Thus, for example, one appropriate schedule would use 10 cycles with lubricant applicator on, and 20 cycles with lubricant applicator off.

The testing included many different setups, such a fresh overcoated photoreceptor with the BCR charger at the high setting. Results from this are shown in FIG. 5, where again torque is plotted as a function of cycling through the five phases of the test run. In phase 1, with BCR charging off and delivery roller out-of-contact, the torque is seen to rise steadily as the system runs without lubrication. In phase 2, with BCR charging on and delivery roller out-of-contact, the torque rises exponentially as the BCR plasma increases friction between the photoreceptor surface and the cleaning blade. In phase 3, with BCR charging off and delivery roller in-contact, torque drops immediately as the lubricant delivered to the photoreceptor decreases friction. In phase 4, with BCR charging on and delivery roller in continuous contact, torque rises slightly but levels off as the friction increasing effect of the plasma is mitigated by the continuous application of the lubricant. In phase 5, with BCR charging on and delivery roller in intermittent contact, the torque initially drops when the delivery roll is pulled out of contact with the photoreceptor, as the drive motor no longer needs to drive the delivery roller. Once the delivery roller is out of contact, torque increases monotonically until it reaches the steady state level at the end of phase 4, at which point it was predetermined to reengage the delivery roller for another set of cycles.

After applying lubricant for another set of cycles the delivery roller was again pulled out of contact with the photoreceptor and correspondingly the torque dropped. Again torque was allowed to build to the steady state level reached in phase 4, before the delivery roller was reengaged. In this way, the delivery could be optimized based on the ratio of the number of cycles that the delivery roller is to be in contact versus the number of cycles that it can be out of contact, without the torque rising above the continuous application steady state level of phase 4.

Table 1, below shows a summary of results from the lubricant delivery rate optimization testing.

| BCR Setting | Torque (Nm) with Continuous Roller Application | Ratio of Cycles with Roller Application On to Roller Application Off needed to maintain same Torque as Continuous application |
|---|---|---|
| Low (−600 V DC and 1.64 KV AC @ 1.5 KHz) | 0.4 | 1:2 |
| High (−725 V DC and 1.80 KV AC @ 1.5 KHz) | 0.35 | 2:1 |

As is detailed herein, the systems and methods herein use a process of intermittent contact that extends delivery roll life by a factor of 3 (for example, approx. 850 Kcycles to approx. 2500 Kcycles) reduces the rate of delivery roller contamination from toner and additives that pass under the cleaning blade. Further, it was unexpected (and even possibly somewhat counter-intuitive) that the delivery roll could still be effective when only applied intermittently.

Figure 6:
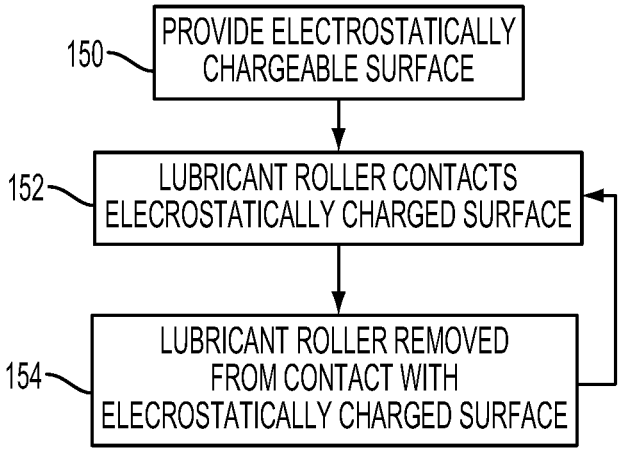
FIG. 6 is a flowchart illustrating operation of systems and methods herein.

FIG. 6 is flowchart illustrating an exemplary method herein. In item 150, exemplary methods herein provide an electrostatically chargeable surface within a printing apparatus (e.g., photoreceptor belt, photoreceptor drum, biased charge roller, etc.). In item 152, such methods cause a movable lubricant applicator to contact the electrostatically chargeable surface. The movable lubricant applicator is movable to be in contact with the electrostatically chargeable surface, or out of contact with the electrostatically chargeable surface. Such methods control the movable lubricant applicator to be in intermittent contact with the electrostatically chargeable surface during printing operations of the printing apparatus as shown by the loop between items 152 and 154. In item 152, the movable lubricant applicator is moved to be in contact with the electrostatically chargeable surface and in item 154, the movable lubricant applicator is removed from contacting the electrostatically chargeable surface. In specific examples, the methods can control the movable lubricant applicator to be in contact with the electrostatically chargeable surface less than one-third of any time period during the printing operations of the printing apparatus. The movable lubricant applicator (e.g., a brush or roller) only applies a lubricant when in contact with the electrostatically chargeable surface, and the lubricant can comprise, for example, paraffin lubricant, etc.

Figure 7:
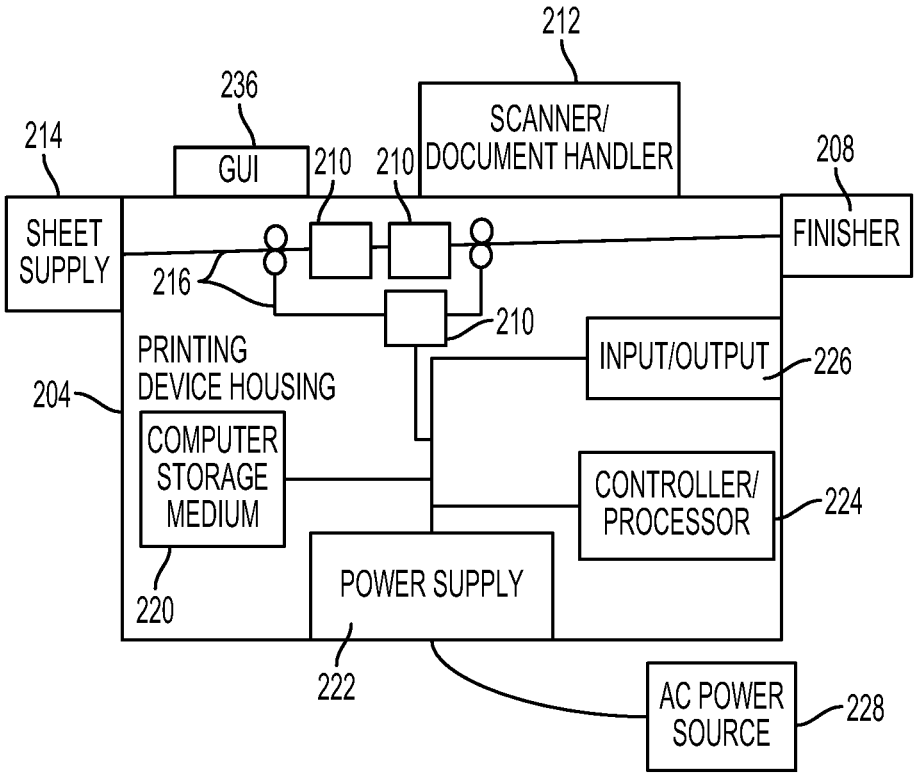
FIG. 7 is a side-view schematic diagram of a device according to systems and methods herein.

As shown in FIG. 7, exemplary system systems and methods herein include a printing device 204, which can be used with systems and methods herein and can comprise, for example, a printer, copier, multi-function machine, multi-function device (MFD), etc. The printing device 204 includes a controller/processor 224 and a communications port (input/output) 226 operatively connected to the processor 224 and to the computerized network 202 external to the printing device 204. Also, the printing device 204 can include at least one accessory functional component, such as a graphic user interface assembly 206 that also operate on the power supplied from the external power source 228 (through the power supply 222).

The input/output device 226 is used for communications to and from the printing device 204. The processor 224 controls the various actions of the computerized device. A non-transitory computer storage medium device 220 (which can be optical, magnetic, capacitor based, etc.) is readable by the processor 224 and stores instructions that the processor 224 executes to allow the computerized device to perform its various functions, such as those described herein. Thus, as shown in FIG. 7, a body housing 204 has one or more functional components that operate on power supplied from the alternating current (AC) 228 by the power supply 222. The power supply 222 can comprise a power storage element (e.g., a battery) and connects to an external alternating current power source 228 and converts the external power into the type of power needed by the various components.

The printing device 204 includes many of the components mentioned above and at least one marking device (printing engines) 210 operatively connected to the processor 224, a media path 216 positioned to supply sheets of media from a sheet supply 214 to the marking device(s) 210, etc. After receiving various markings from the printing engine(s), the sheets of media can optionally pass to a finisher 208 which can fold, staple, sort, etc., the various printed sheets. Also, the printing device 204 can include at least one accessory functional component (such as a scanner/document handler 212, etc.) that also operates on the power supplied from the external power source 228 (through the power supply 222).

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the systems and methods described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printing apparatus comprising:

an electrostatically chargeable surface;

a movable lubricant applicator contacting said electrostatically chargeable surface; and a controller operatively connected to said movable lubricant applicator, said movable lubricant applicator being movable to be one of: in contact with said electrostatically chargeable surface; and out of contact with said electrostatically chargeable surface under control of said controller, said controller controlling said movable lubricant applicator to be in intermittent contact with said electrostatically chargeable surface during printing operations of said printing apparatus, and said controller controlling said movable lubricant applicator to be in contact with said electrostatically chargeable surface less than one-third of any time period during said printing operations of said printing apparatus.

2. The printing apparatus according to claim 1, said movable lubricant applicator applying a lubricant to said electrostatically chargeable surface when in contact with said electrostatically chargeable surface.

3. The printing apparatus according to claim 2, said lubricant comprising paraffin lubricant.

4. The printing apparatus according to claim 1, said movable lubricant applicator comprising one of a brush and a roller.

5. The printing apparatus according to claim 1, said electrostatically chargeable surface comprising one of a photoreceptor belt, a photoreceptor drum, and a biased charge roller.

6. A printing apparatus comprising:

a photoreceptor;

a movable lubricant applicator contacting said photoreceptor; and a controller operatively connected to said movable lubricant applicator, said movable lubricant applicator being movable to be one of: in contact with said photoreceptor; and out of contact with said photoreceptor under control of said controller, and said controller controlling said movable lubricant applicator to be in intermittent contact with said photoreceptor during printing operations of said printing apparatus, and said controller controlling said movable lubricant applicator to be in contact with said photoreceptor less than one-third of any time period during said printing operations of said printing apparatus.

7. The printing apparatus according to claim 6, said movable lubricant applicator applying a lubricant to said photoreceptor when in contact with said photoreceptor.

8. The printing apparatus according to claim 7, said lubricant comprising paraffin lubricant.

9. The printing apparatus according to claim 6, said movable lubricant applicator comprising one of a brush and a roller.

10. The printing apparatus according to claim 6, said photoreceptor comprising one of a belt and a roller.

11. A method comprising:

providing an electrostatically chargeable surface within a printing apparatus;

causing a movable lubricant applicator to contact said electrostatically chargeable surface, said movable lubricant applicator being movable to be one of: in contact with said electrostatically chargeable surface; and out of contact with said electrostatically chargeable surface;

controlling said movable lubricant applicator to be in intermittent contact with said electrostatically chargeable surface during printing operations of said printing apparatus; and controlling said movable lubricant applicator to be in contact with said electrostatically chargeable surface less than one-third of any time period during said printing operations of said printing apparatus.

12. The method according to claim 11, said causing said movable lubricant applicator to contact said electrostatically chargeable surface comprising causing said movable lubricant applicator to apply a lubricant to said electrostatically chargeable surface when in contact with said electrostatically chargeable surface.

13. The method according to claim 12, said lubricant comprising paraffin lubricant.

14. The method according to claim 11, said movable lubricant applicator comprising one of a brush and a roller.

15. The method according to claim 11, said electrostatically chargeable surface comprising one of a photoreceptor belt, a photoreceptor drum, and a biased charge roller.

16. A method comprising:

beginning printing operations within a printing apparatus;

causing a movable lubricant applicator to contact a photoreceptor within said printing apparatus, said movable lubricant applicator being movable to be one of: in contact with said photoreceptor; and out of contact with said photoreceptor under control of a controller within said printing apparatus;

controlling, under control of said controller, said movable lubricant applicator to be in intermittent contact with said photoreceptor during said printing operations of said printing apparatus; and controlling said movable lubricant applicator to be in contact with said photoreceptor less than one-third of any time period during said printing operations of said printing apparatus.

17. The method according to claim 16, said causing said movable lubricant applicator to contact said photoreceptor comprising causing said movable lubricant applicator to apply a lubricant to said photoreceptor when in contact with said photoreceptor.

18. The method according to claim 17, said lubricant comprising paraffin lubricant.

19. The method according to claim 16, said movable lubricant applicator comprising one of a brush and a roller.

20. The method according to claim 16, said photoreceptor comprising one of a belt and a roller.

* * * * *